US005228627A

United States Patent [19]

Yang

[11] Patent Number: 5,228,627

[45] Date of Patent: Jul. 20, 1993

[54] CRUSHING MACHINE

[76] Inventor: Mu-Tsang Yang, No. 52, Ta Ping Rd., To Ti Li, Sha Lu Chen, Taichung Hsien, Taiwan

[21] Appl. No.: 955,132

[22] Filed: Oct. 1, 1992

[51] Int. Cl.[5] ..... B67D 5/38; B05B 3/04

[52] U.S. Cl. ..... 241/73; 241/241

[58] Field of Search ..... 241/73, 68, 239, 240, 241/241, 241.5, 300, 301

[56] References Cited

U.S. PATENT DOCUMENTS

| | | | |
|---|---|---|---|
| 988,293 | 3/1911 | Moffitt | 241/300 |
| 1,666,797 | 4/1928 | Snyder | 241/73 |
| 2,225,781 | 12/1940 | Hinerfeld | 241/73 |
| 2,582,734 | 1/1952 | Adams | 241/239 X |
| 2,890,840 | 6/1959 | Fletcher et al. | 241/73 |
| 3,083,921 | 4/1963 | Danyluke et al. | 241/240 X |

*Primary Examiner*—Douglas D. Watts
*Attorney, Agent, or Firm*—Browdy and Neimark

[57] ABSTRACT

An improved crushing machine comprises the following components: two bottom bases parallel to each other; two side bases fastened respectively on the two bottom bases; a spindle arranged at the center of the two side bases; a predetermined number of knife cores fastened to the spindle; a predetermined number of inner knives mounted on the knife cores so as to rotate in conjunction with the spindle to form a circular cutting track; two locking rings mounted respectively in the inner wall surfaces in such a manner that they are coaxial with the spindle; a predetermined number of knife mounts fastened to the two side bases and locked by the locking rings, with two adjacent knife mounts forming therebetween a knife inserting hole; and outer knife sets corresponding in number to the knife inserting holes. Each outer knife set comprises: an outer knife; an insertion block received along with the outer knife in the knife inserting hole; a predetermined number of baffles arranged pivotally and dismountably in the knife inserting hole; and a predetermined number of bolts. The crushing machine further comprises a feeding funnel, a filter, and a motor.

7 Claims, 7 Drawing Sheets

CRUSHING MACHINE

BACKGROUND OF THE INVENTION

The present invention relates to an improved crushing machine.

As shown in FIGS. 1 and 2, a prior art crushing machine has a machine board 11 provided with two slots 12 for mounting therein respectively an outer cutting tool 13 and an urging block 14. The urging block 14 has two threaded holes 15, while the machine board 11 has two bored holes 16 and two threaded holes 17, which are respectively corresponding in location to the urging block 14 and the outer cutting tool 13. In the process of fastening the outer cutting tool 13, two adjusting screws 18 must be fastened first with the two threaded holes 17 of the machine board 11 so as to hold the both heads of the outer cutting tool 13. As a result, the location and the horizontal position of the outer cutting tool 13 can be properly adjusted. In addition, the outer cutting tool 13 can be further secured in place by means of two fastening screws 19 which pass respectively through the two bored holes 16, so as to engage respectively the two threaded holes 15 of the urging block 14, which is then forced gradually into the slot 13 to fasten the outer cutting tool 13. Such prior art layout, as described above, is defective in design in that the machine board 11 must be dismounted in its entirety at such time when a replacement of the outer cutting tool 13 is called for, and that the process of replacing the outer cutting tool 13 is tedious and highly technical, and further that such replacement process is complicated by the fact that it must be done once a month by a skilled maintenance personnel.

In addition, the machine body of the prior art crushing machine is constructed with iron boards by welding. Such iron boards must be individually cut in accordance with certain specifications. Upon the completion of building the machine body of the prior art crushing machine, a drive shaft is mounted securely in the machine body. A cutting tool mount is fastened to the shaft for securing thereto an inner cutting tool. The outer cutting tool is mounted on the outer wall of the machine body. A motor mounted by or behind the machine body is furnished for driving the shaft. The manufacture of such prior art crushing machine requires many costly man hours of the skilled workers, thereby resulting in a substantial increase in the overall cost of making the machine.

Moreover, the feeding port of the prior art crushing machine is generally made up of thin iron plates. The crushed pieces of the fed material often bounce back up to hit the feeding port, thereby making a noise. In addition, a resonance of the feeding port caused by the vibration of the motor in operation can be a factor responsible for such a noise.

SUMMARY OF THE INVENTION

It is, therefore, the primary objective of the present invention to provide a crushing machine with an improved means, which facilitates the fastening and the replacing of an outer cutting tool of the crushing machine.

It is another objective of the present invention to provide a crushing machine made up of members, each of which has a fixed shape and can be individually made so as to improve the quality and the production rate of the crushing machine.

It is still another objective of the present invention to provide a crushing machine with a solid and stable machine body capable of operating without making a noise.

In keeping with the principles of the present invention, the foregoing objectives of the present invention are accomplished by a crushing machine, which comprises two bottom bases parallel to each other, a housing containing therein a receiving space, a feeding funnel in communication with the receiving space of the housing, a filtration means disposed at the bottom of the housing, a set of rotation means mounted in the receiving space of the housing, a motor for driving the rotation means, a predetermined number of inner cutting tools mounted separately on the rotation means in such a manner that they form a circular cutting track, and a predetermined number of outer cutting tools mounted separately on the housing in such a manner that their cutting edges are adjacent to the circular cutting track of the inner cutting tools, so as to bring about a shearing action. The crushing machine is characterized in that its housing further comprises two side bases parallel to each other, each of which is provided at the center thereof with a main through hole for mounting therein the rotation means and with a predetermined number of adjunct through holes located a predetermined distance away from the left and the right sides of the main through hole. The housing is still composed of a predetermined number of cutting tool mounts corresponding in number to the adjunct through holes of the side base. Each of the cutting tool mounts has two ends provided respectively and coaxially a projected column which is fastened securely in the adjunct through hole of the side base, so as to form the receiving space between the two side bases and the cutting tool mounts and to form separately a knife inserting hole, which is located between the two adjacent cutting tool mounts and is in communication with the receiving space and with the outside of the housing for an outer cutting tool to be inserted thereinto. Each cutting tool mount is further provided with an elongate slot along the longitudinal axis thereof and opposite to the knife inserting hole, and with a predetermined number of recesses. The housing is still composed of two locking rings, each of which is mounted securely in the inner wall surface of the side base in such a manner that it is coaxial with the rotation means. The locking ring has an outer diameter greater than the outer diameter of the circular cutting track of the inner cutting tool. The outer wall surface of the locking ring frame is used for locking the cutting tool mount. The locking ring is provided with a groove corresponding in location to the insertion position of the outer cutting tool for the purpose of locking the outer cutting tool. Each of the knife inserting holes is provided with an insertion block of a wedge-shaped construction. The insertion block lodged in the knife inserting hole is intended for use in retaining the outer cutting tool securely in place and is provided with a predetermined number of threaded holes. The housing still further comprises a predetermined number of baffles, each of which has a main body rectangular in shape. The main body is provided with two shoulders and with two threaded holes and further with a through hole. A predetermined number of bolts are used to help retain the outer cutting tool and the insertion block securely in place.

DETAILED DESCRIPTION OF THE PREFERRED EMBODIMENT

Referring to FIGS. 3-13, a crushing machine of the present invention is shown to comprise structures as follows:

Two bottom bases 20 parallel to each other and having an L-shaped construction.

Figure 6:
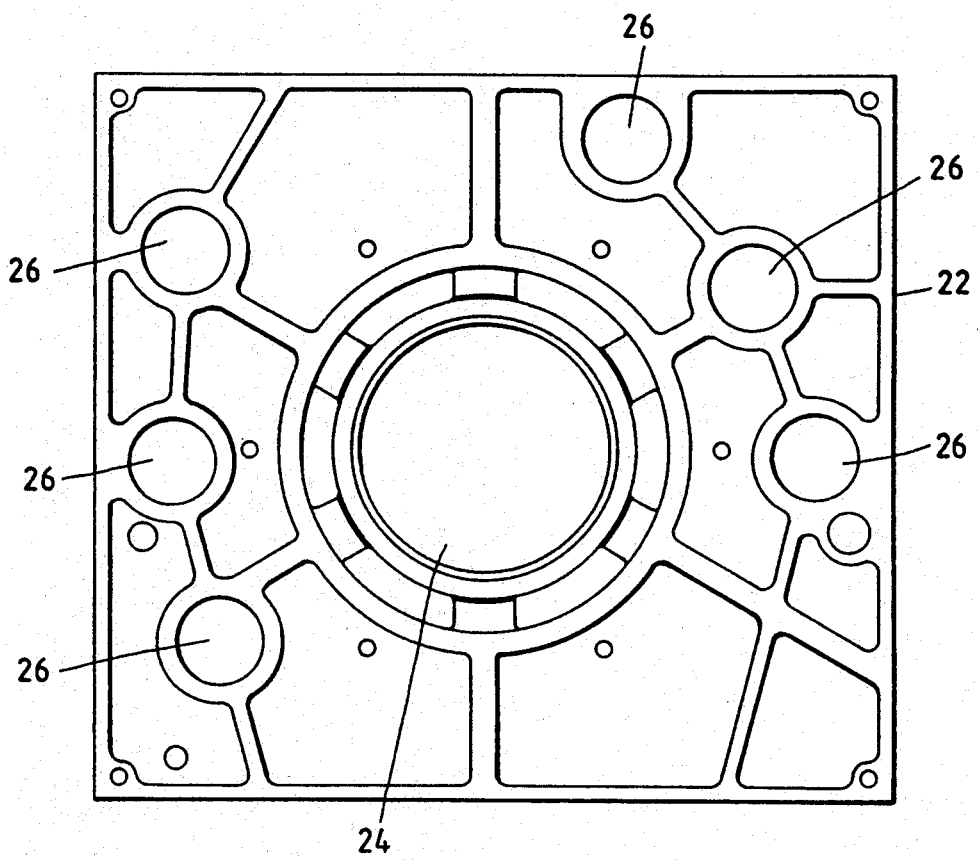
FIG. 6 shows a plan view of a right side base of the crushing machine of the present invention.

Two side bases 22 parallel to each other and located over the bottom bases 20. Each side base 22 is provided at the center thereof with a main through hole 24 and with six adjunct through holes 26, as shown in FIG. 6, with three adjunct through holes 26 arranged in a group located respectively a predetermined distance away from the left and the right sides of the main through hole 24.

A spindle 28 is pivotally mounted in the two main holes 24 by means of bearings 30.

Four knife cores 32 are fastened respectively at the predetermined positions of the spindle 28.

Six inner knives 34, each of which has two ends provided respectively with an elongate hole 36 along the short axis of the inner knife. A bolt 38 is put through the elongate hole 36 to engage the knife core 32. Another bolt 40 engaging the knife core 32 is employed to urge the rear end wall of the inner knife 34 for adjusting the length of extension of the knife blade of the inner knife 34, which rotates along with the spindle to form a circular cutting track. The mounting portion of the inner knife 34 is similar in structure to that of the prior art inner knife and will not be therefore described here.

Figure 7:
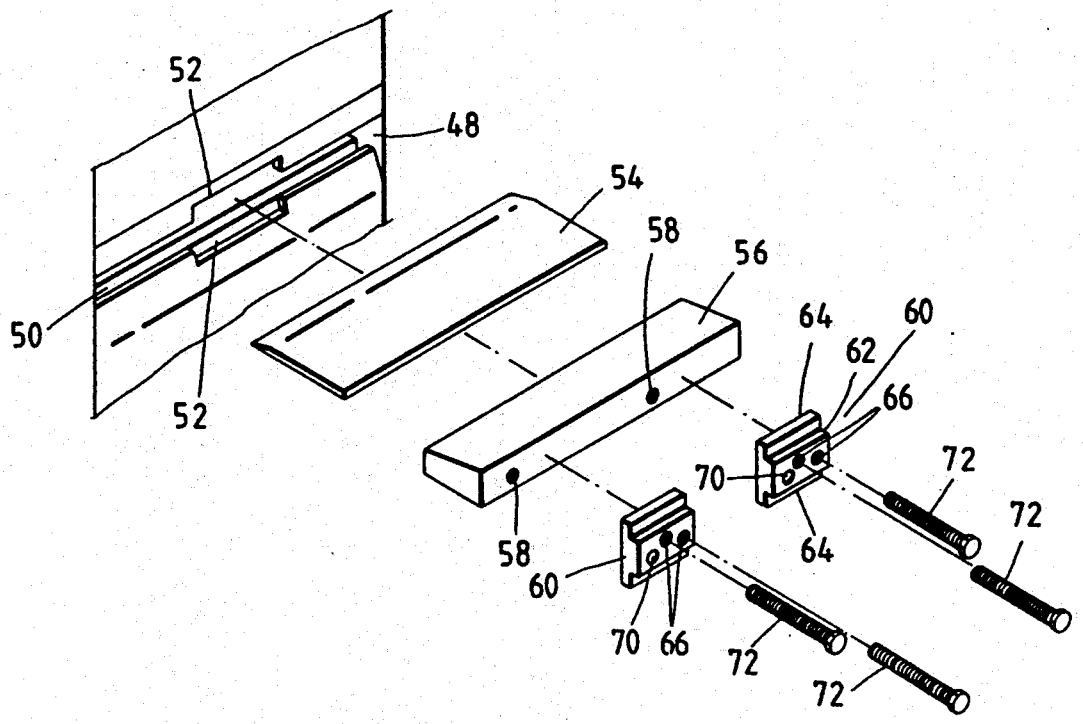
FIG. 7 is a partial exploded view showing the fastening structures of an outer cutting tool of the crushing machine of the present invention.

Six knife mounts 42, each of which has two ends provided respectively and coaxially with a projected column 44 which is received in the adjunct through hole 26 of the side base 22. The projected column 44 is fastened by means of a nut 46. As a result, a total of four knife inserting holes 48 are formed, as shown in FIG. 7. The knife mount 42 is provided with an elongate slot 50. Both upper and lower elongate slots 50 are provided respectively at the center thereof with a recess 52.

Four sets of outer knives are mounted respectively in the knife inserting holes 48, as shown in FIGS. 7-12. Each set of outer knife comprising:

An outer knife 54 having a cutting blade adjacent to the circular cutting track of the inner knife 34.

An insertion block 56 of a wedge-shaped construction for use in retaining the outer knife 54, with the exposed end of the insertion block 56 provided with two threaded holes 58.

Two baffles 60, each of which has a rectangular main body 62 provided with two shoulders 64. The baffle 60 is placed into the upper and the lower elongate slots 50 of the knife inserting hole 48 via the recess 52, with its shoulder 64 disposed slidably in the elongate slot 50 in such a manner that it can be withdrawn via the recess 52. The main body 62 of the baffle 60 has a threaded hole 66 corresponding in location to the height of the outer knife 54 and the insertion block 56 being inserted in the knife insertion hole 48. A through hole 70 is disposed by the threaded hole 66.

Four bolts 72 are disposed respectively in the threaded holes 66 of the two baffles 60 for use in pressing the outer knife 54 and the insertion block 56.

Figure 1:
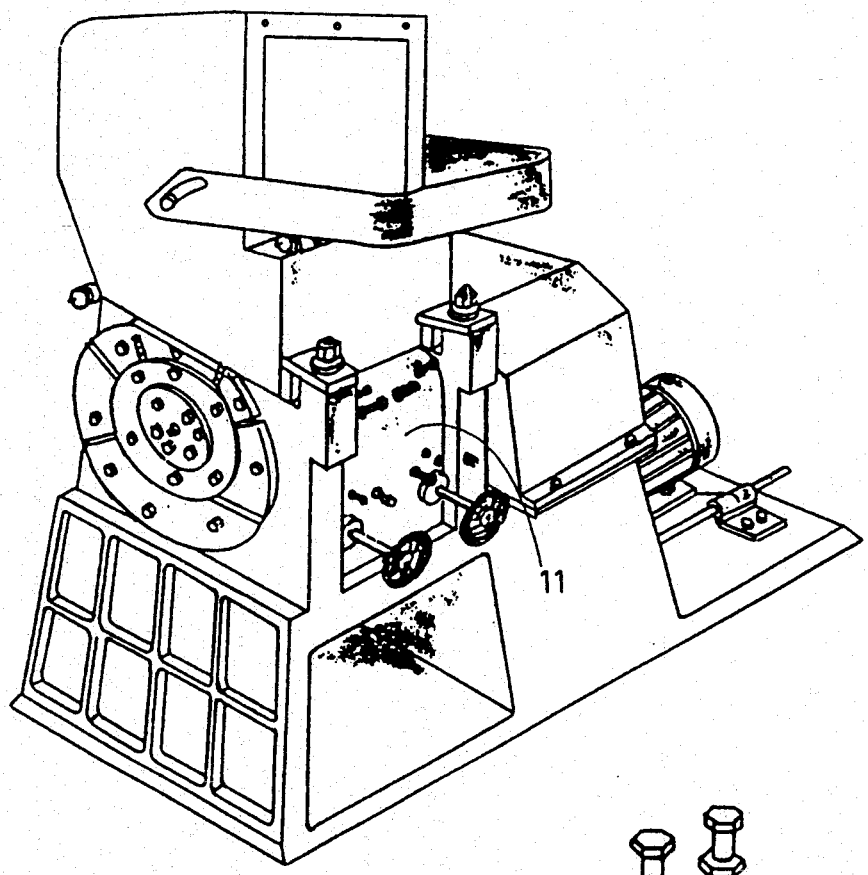
FIG.1 PRIOR ART
FIG. 1 shows a perspective view of a crushing machine of the prior art.
Figure 2:
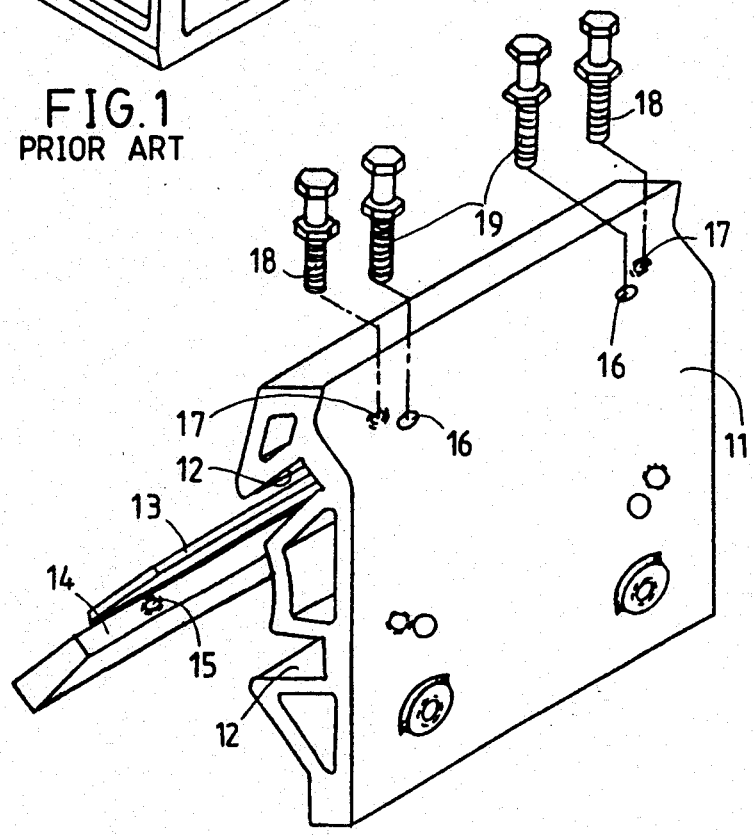
FIG.2 PRIOR ART
FIG. 2 is an exploded view showing the way that an outer cutting tool is fastened according to the crushing machine of the prior art.
Figure 3:
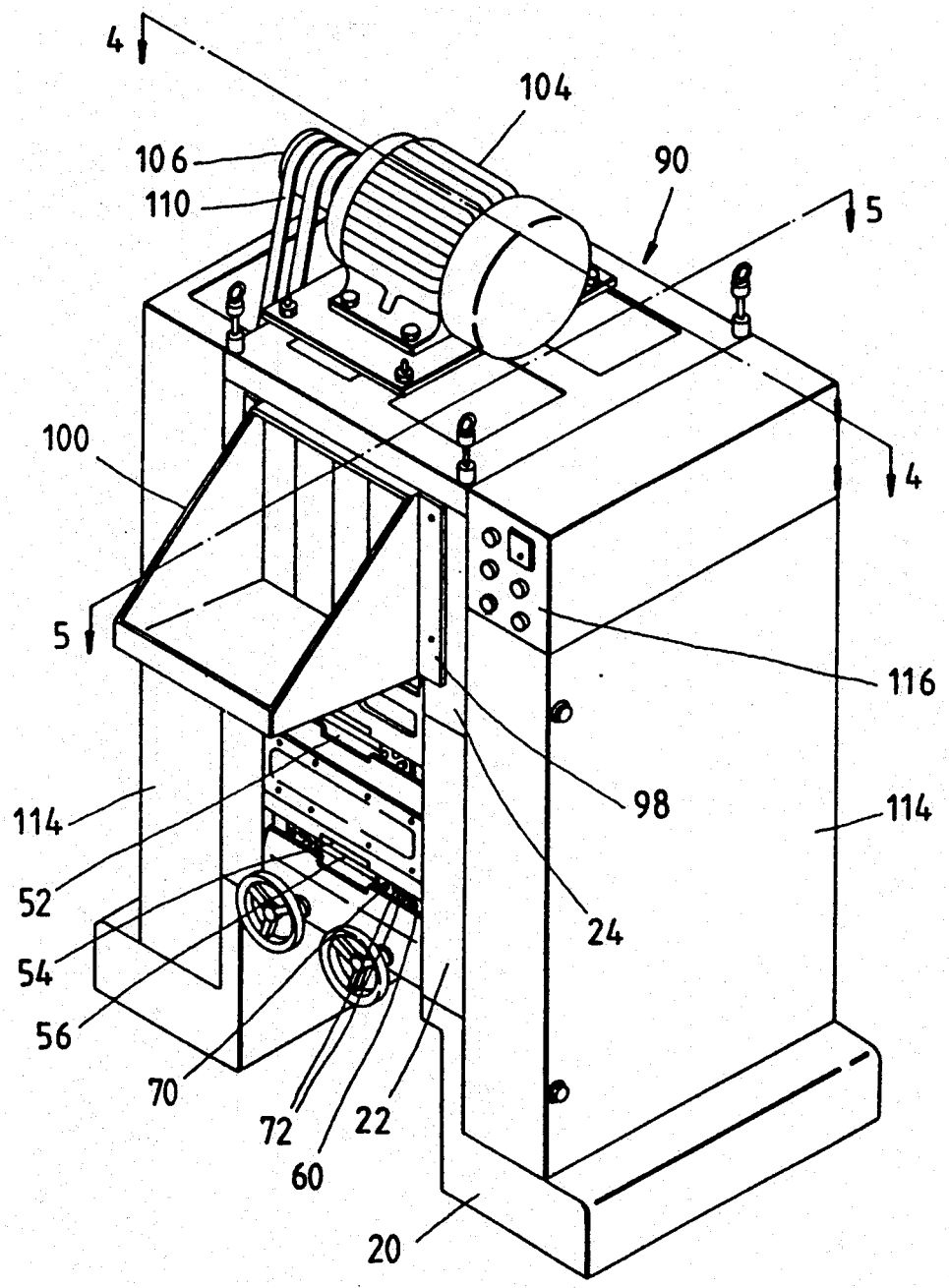
FIG. 3 shows a perspective view of a crushing machine of the present invention.
Figure 4:
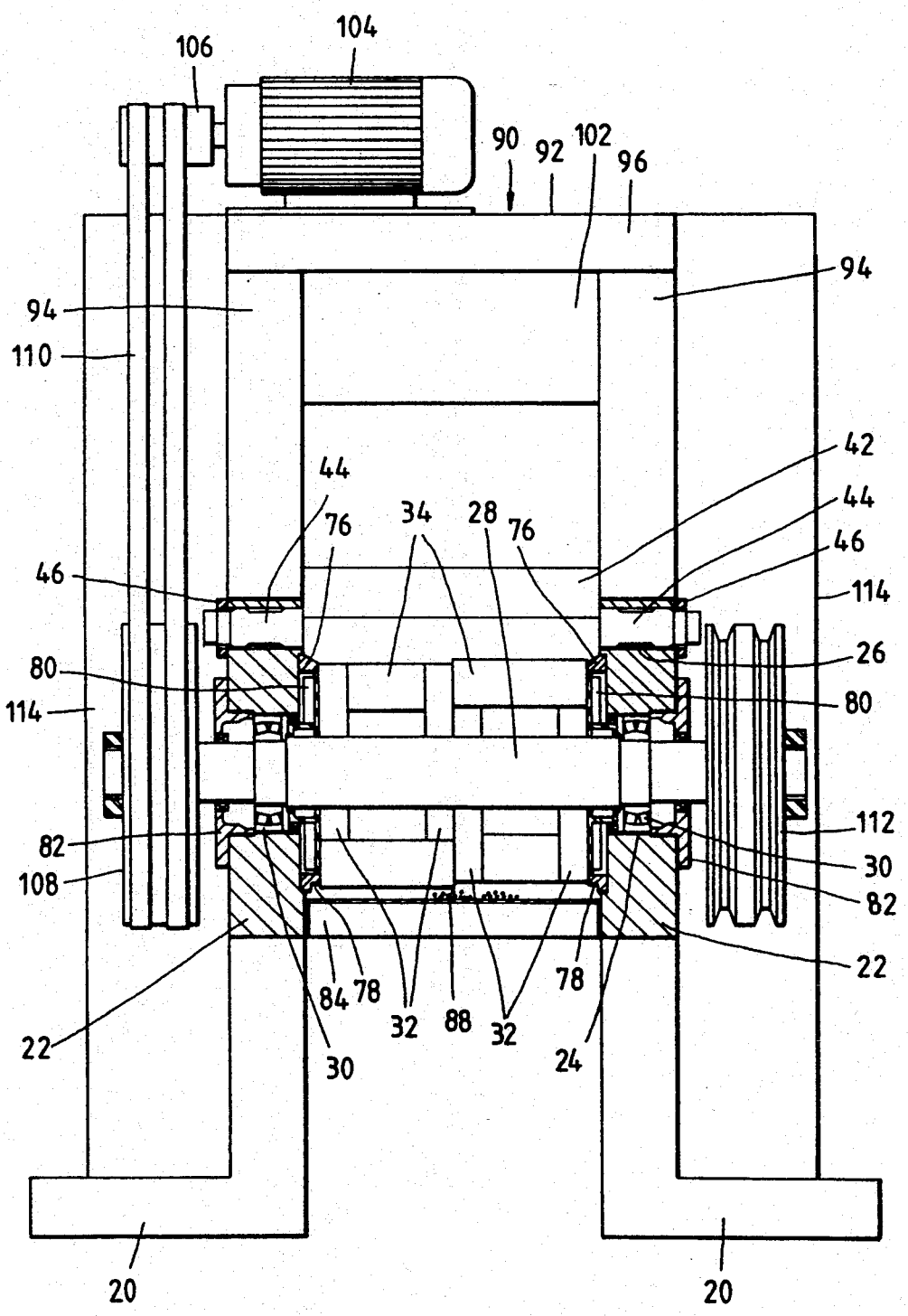
FIG. 4 shows a sectional schematic view of a portion taken along a line 4—4 as shown in FIG. 3.
Figure 5:
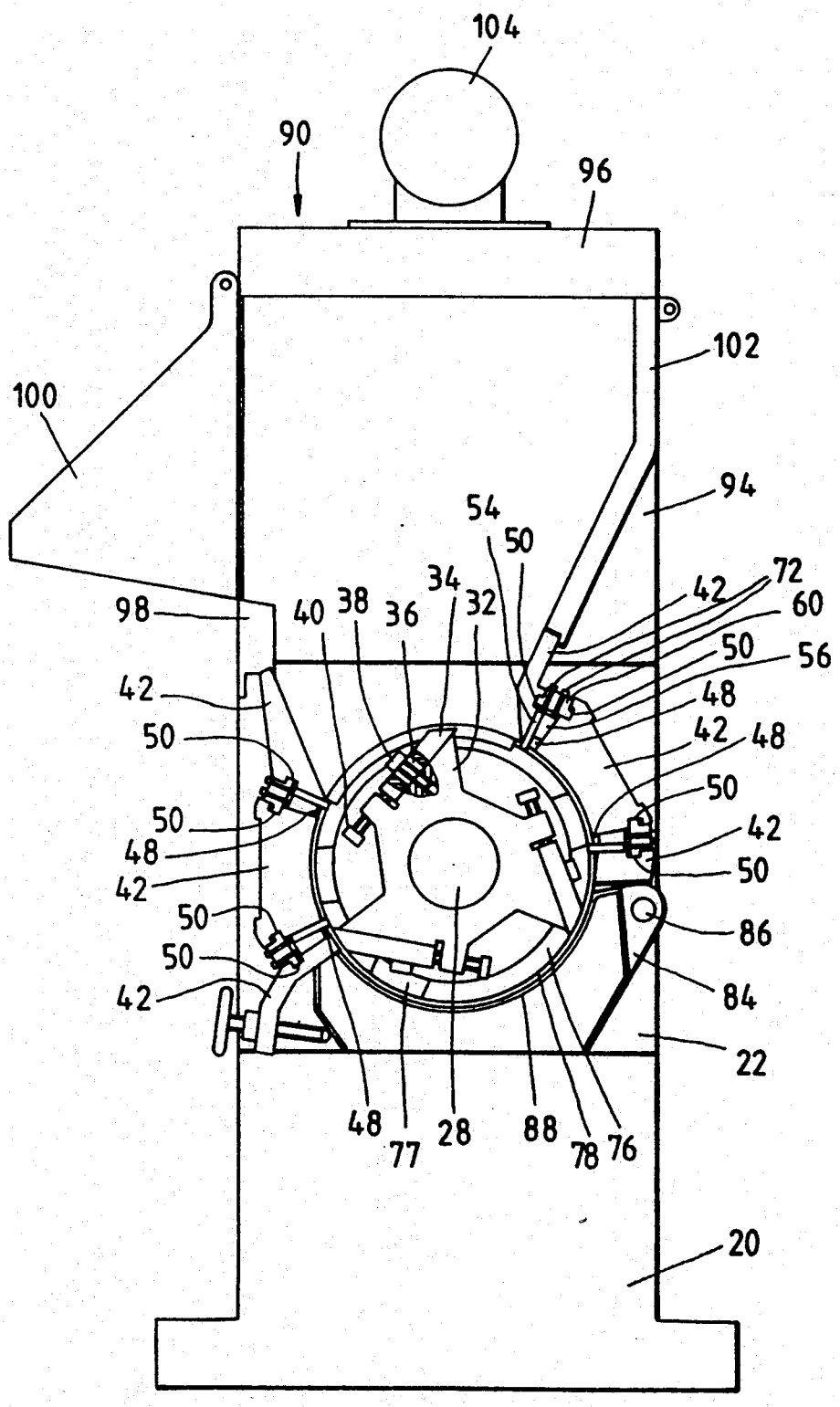
FIG. 5 shows a sectional schematic view of a portion taken along a line 5—5 as shown in FIG. 3.
Figure 13:
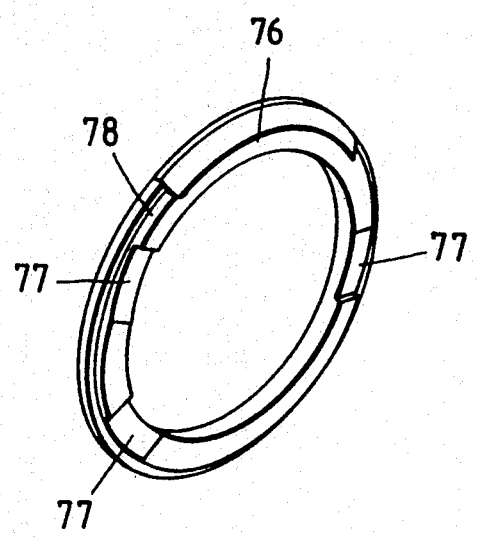
FIG. 13 shows a perspective view of a locking ring of the crushing machine of the present invention.

As shown in FIGS. 4, 5 and 13, two locking rings 76 are respectively lodged in the inner wall surface of the two side bases 22 in such a manner that they are concentric with the spindle 28. Each of the two locking rings 76 has an outer diameter greater than the circular cutting track of the inner knives 34. The outer wall surfaces of the locking rings 76 are for use in retaining the knife mount 42. The locking rings 76 are provided with grooves 78 corresponding in location to the position of the outer knife 54. The grooves 78 are intended for use in retaining the outer knife 54.

Two heat-radiating disks 80 are fastened to the spindle 28 and are situated respectively between the two locking rings 76.

Two dust shields 82 are pivotally mounted on the spindle 28 and are respectively fastened to the outer wall surfaces of the two side bases 22 for the purpose of protecting the main through hole 24 from the dust.

A filter support 84 is pivotally disposed on the two side bases 22 by a pivot 86 in such a manner that it covers the spindle 28, the knife cores 32, and the bottom surfaces of the inner knives 34. The filter support 84 can be rotated downward by the pivot 86 working as a rotation shaft.

A filter 88 having an arcuate surface is mounted on the filter support 84 for screening the crushed material.

A feeding funnel 90 is mounted over the two side bases 22 and is composed of: a main body 92 made up of two side boards 94 fastened respectively over the two side bases 22 and of a top board 96 fastened to the top surfaces of the two side boards 94; a front cover board 98 hinged to the front end of the top board 96 and provided with a funneled feeding port 100; and a rear cover board 102 hinged to the rear end of the top board 96 in such a way that it can be lifted for facilitating the clean-up and the replacement of the inner knives 34.

A motor 104 is mounted securely on the top board 96 of the feeding funnel 90.

Two belted wheels 106 and 108 are respectively fastened to the drive shaft of the motor 104 and to the spindle 28.

A belt 110 is used to transfer the motion from the belted wheels 106 and 108 to the spindle 28.

A fly wheel 112 is fastened to another end of the spindle 28.

Two outer shields 114 are respectively attached to the two sides of the crushing machine.

A control mechanism 116 is mounted on one of the two outer shields 114.

Figure 8:
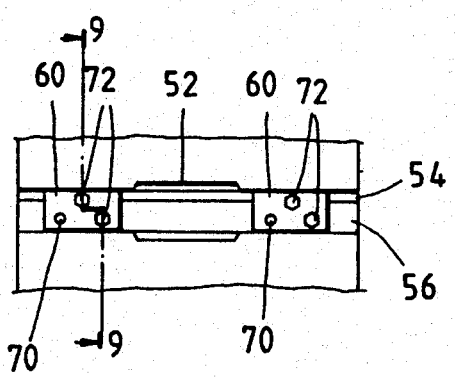
FIG. 8 is a plan view of the fastening structures of FIG. 7 in combination, showing that the outer cutting tool is in a locked state.
Figure 9:
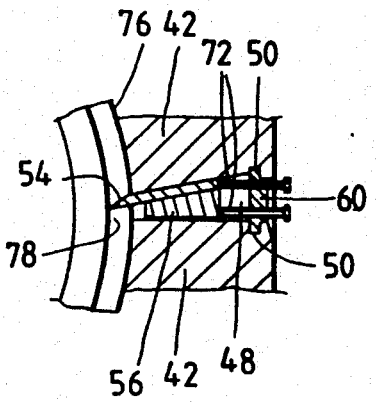
FIG. 9 shows a sectional view of a portion taken along a line 9—9 as shown in FIG. 8.

The mounting and the dismounting of the outer knife set are illustrated in FIGS. 8–12. As shown in FIGS. 8 and 9, the outer knife 54 and the insertion block 56 are placed in the knife inserting hole 48. The insertion block 56 is tightened after the outer knife 54 is locked securely in place in the groove 78 of the locking ring 76. Thereafter, the baffles 60 are lodged pivotally in the two elongate slots 50 via the recess 52. The outer knife 54 and the insertion block 56 are tightened by means of a bolt 72 engaging the threaded hole 66.

Figure 10:
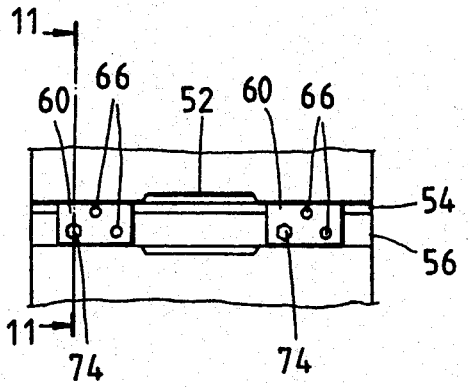
FIG. 10 is similar to FIG. 8, showing that the outer cutting tool is dismounted.
Figure 11:
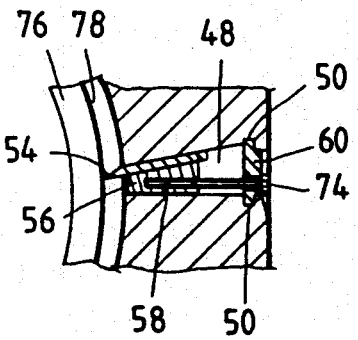
FIG. 11 shows a sectional view of a portion taken along a line 11—11 as shown in FIG. 10.
Figure 12:
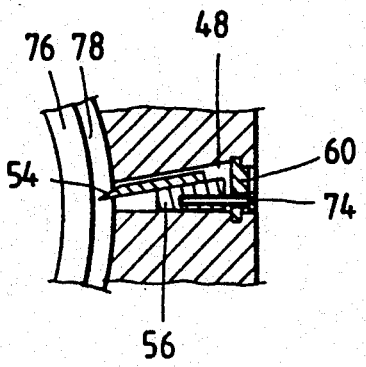
FIG. 12 is similar to FIG. 11, showing that an insertion block has been pulled out.

The process of dismounting and replacing the outer knife 54 is illustrated in FIGS. 10–12. The bolt 72 must be disengaged and removed from the threaded hole 66 so that the baffle 60 can be adjusted to permit the through hole 70 to be aligned with the threaded hole 58 of the insertion block 56. A bolt 74 is put through the through hole 70 to engage the threaded hole 58. The bolt 74 is then tightened gradually until it is obstructed by the baffle 60, thereby resulting in the insertion block 56 being pushed outwards, as shown in FIG. 12. As soon as the insertion block 56 and the outer knife 54 are loosened, the bolt 74 can be disengaged and removed from the threaded hole 58. As a result, the baffle 60 can be taken out via the recess 52. The outer knife 54 and the insertion block 56 can be therefore dismounted.

As shown in FIG. 13, the locking ring 76 can be further provided with a groove 77 having a shallow portion and a deep portion with an upright wall surface. The knife core 32 of the side base 22 is adjacent to the locking ring 76, with the swiveling track of the knife core 32 reaching the groove 77 without reaching beyond the locking ring 76. Therefore, the crushed material can be further pounded into smaller pieces by a shearing action between the knife core 32 and the upright wall of the locking ring 76.

On the basis of the disclosure presented above, it is apparent that the outer knives of the crushing machine of the present invention can be replaced handily. In addition, the various component parts of the crushing machine of the present invention can be made in quantity by various manufacturers and then assembled by a single manufacturer of the crushing machine.

The crushing machine of the present invention is provided with a feeding funnel having a rear cover board or a front cover board, which can be lifted to facilitate the replacing of the inner knives. In addition, the feeding funnel of the present invention is so mounted fixedly that it does not make a noise at such time when the process of feeding the material into the machine is under way. Moreover, the motor of the crushing machine is mounted on the feeding funnel, so as to reduce the size of the floor space that the crushing machine occupies and to allow a formation of a through way between the two bottom bases 20 for arranging therein a material collecting means, or a conveyer, or a storage means of rinsing water.

What is claimed is:

1. A crushing machine comprising:

two bottom bases parallel to each other;

a housing arranged on said two bottom bases and provided with a receiving space;

a feeding funnel arranged on said housing and communicating with said receiving space of said housing;

a filter disposed at the bottom of said housing;

a rotating mechanism mounted pivotally in said receiving space of said housing and capable of being driven by an external force;

a motor for use in driving said rotating mechanism;

a predetermined number of inner knives fastened respectively to said rotating mechanism so as to form a circular cutting track at such time when said rotating mechanism and said inner knives rotate synchronously;

a predetermined number of outer knives arranged at predetermined locations of said housing in such a way that the tips of said outer knives are adjacent to said circular cutting track of said inner knives so as to form a shearing action;

wherein said crushing machine is characterized in that said housing comprising:

two side bases parallel to each other, with each of said two side bases provided at the center thereof with a main through hole and a predetermined number of adjunct through holes spaced apart from said main through hole;

knife mounts corresponding in number to said adjunct through holes, with each of said knife mounts provided respectively at both ends thereof with a coaxially projected column to be received in said adjunct through hole corresponding in location to said projected column, thereby forming said receiving space between said two side bases and said knife mounts and further forming a knife inserting hole which is located between the two of said knife mounts and is in communication with said receiving space, with each of said knife mounts provided with an elongate slot and a predetermined number of recesses;

two locking rings mounted respectively in the inner wall surfaces of said two side bases in such a manner that they are coaxial with said rotating mechanism, with each of said locking rings having an outer diameter greater than an outer diameter of said circular cutting track of said inner knives, and with each of said locking rings having an outer wall surface for locking said knife mount and having a groove for locking said outer knife;

each of said outer knives being inserted into said knife inserting hole in such a manner that the front end of said outer knife urges said grooves of said locking rings, said knife inserting hole being provided with:

an insertion block of a wedge-shaped construction having a predetermined number of threaded holes;

a predetermined number of baffles, each of which has a rectangular main body provided with two shoulders and is arranged pivotally in said elongate slots of said knife inserting hole via said recesses of said knife inserting hole, said main body comprising a threaded hole corresponding in location to said outer knife and the height of said insertion block, said main body further comprising a through hole adjacent to said threaded hole;

a predetermined number of bolts engaging respectively said threaded holes of said baffles.

2. The crushing machine of claim 1 wherein said rotaing mechanism comprises:

a spindle disposed pivotally by means of a bearing in said main through hole of said two side bases in such a manner that said spindle is driven by said motor; and a predetermined number of knife cores fastened to said spindle for locking said inner knives.

3. The crushing machine of claim 1 wherein said feeding funnel comprises:

a main body of an inverted U-shaped construction mounted on said two side bases;

a front cover board hinged to a front end of said main body and provided with a funneled feeding port; and a rear cover board hinged to a rear end of said main body.

4. The crushing machine of claim 3 wherein said main body of said feeding funnel comprises two side boards fastened respectively to said two side bases, a top board fastened to the tops of said two side boards and a motor fastened to said top board.

5. The crushing machine of claim 1 wherein said motor is mounted on said feeding funnel.

6. The crushing machine of claim 1 wherein said locking rings have a predetermined number of grooves having a shallow portion and a deep portion provided with an upright wall; and wherein said knife cores rotate to form a track which reaches said grooves of said locking rings to form a shearing action.

7. The crushing machine of claim 1 wherein said filter is mounted on a filter support which is in turn mounted on said two side bases by means of a pivot in such a way that said filter covers the bottoms of said spindle, said knife cores and said inner knives and that said filter can be lifted on said pivot.

* * * * *